United States Patent [19]

Evans

[11] Patent Number: 4,722,553

[45] Date of Patent: Feb. 2, 1988

[54] CHEQUE BOOK ASSEMBLY

[75] Inventor: Peter J. Evans, Northfield, England

[73] Assignee: Kalamazoo plc, Birmingham, England

[21] Appl. No.: 919,361

[22] Filed: Oct. 16, 1986

[30] Foreign Application Priority Data

Oct. 18, 1985 [GB] United Kingdom ..... 8525782

[51] Int. Cl.[4] ..... B41L 1/00; B41L 1/20; B42D 15/00; B42D 11/00

[52] U.S. Cl. ..... 282/9 R; 282/24 A; 283/58; 283/59

[58] Field of Search ..... 283/42, 43, 44, 58, 283/59, 60 R, 61, 62, 66 R; 282/9 R, 10, 11, 24 A; D19/11; 383/37; 229/92.7

[56] References Cited

U.S. PATENT DOCUMENTS

| | | | |
|---|---|---|---|
| 869,054 | 10/1907 | Brown | 282/9 R |
| 2,274,910 | 3/1942 | Newton | 282/24 A |
| 2,370,377 | 2/1945 | Stone | 282/9 R |
| 2,470,586 | 5/1949 | Tathwell | 292/9 R |
| 2,546,584 | 3/1951 | Brock, Jr. | 282/9 R |
| 3,254,906 | 6/1966 | Moss | 283/58 |
| 3,587,845 | 6/1971 | Wing | 383/37 |
| 4,014,566 | 3/1977 | Cantrell et al. | 283/59 |
| 4,225,157 | 9/1980 | Hamacher | 283/58 |

*Primary Examiner*—Paul A. Bell
*Assistant Examiner*—Paul M. Hegrana, Sr.
*Attorney, Agent, or Firm*—Solon B. Kemon

[57] ABSTRACT

A cheque book assembly comprises carrier leaves arranged one above another and bound together at their right hand ends. Cheques making up a sub-set are bound detachably to each carrier leaf at their left hand ends with a staggered overlap between the cheques. A pressure sensitive strip causes an inscription on an elongated field of a first cheque to be reproduced on a corresponding field on the first carrier leaf to provide a journal entry for the first cheque. Other pressure sensitive strips cause inscriptions on the other cheques to be reproduced on other fields of the carrier leaf, these fields being offset from one another by the stagger of the cheques to form a journal for the sub-set of cheques. A first analysis leaf overlying the first sub-set of cheques is bound to the carrier leaves at the right hand edge thereof and has analysis fields delineated on the under surface thereof such that when opened away from the first carrier leaf analysis fields for each cheque are provided to the right of the journal entries. The under surfaces of successive carrier leaves define analysis fields opposite corresponding journal entries on the next successive carrier leaf for subsequent sub-sets of cheques.

6 Claims, 5 Drawing Figures

CHEQUE BOOK ASSEMBLY

BACKGROUND TO THE INVENTION

The invention relates to a cheque book assembly including a set of cheques having facilities for journal entries recording particulars of cheques issued therefrom and for analysis entries for classifying of the expenditure.

It is already known to provide a cheque book for this purpose in which a plurality of carrier leaves are arranged in book form between sub-sets of cheques. Each sub-set has the cheques overlaying the carrier leaf in a staggered overlap with respect to one another and bound detachably into the book such that the carrier leaves and cheques are bound together down their left hand edges. The first cheque has pressure sensitive reproduction means such as a carbon film for causing an inscription effected on an elongated field forming part of the surface of the cheque to be reproduced on a corresponding first field delineated on the carrier leaf to provide a journal entry for the first cheque on the carrier. Second and successive pressure sensitive reproduction means cause second and successive inscriptions respectivley on second and successive cheques respectively to be reproduced on second and successive fields respectively of the carrier leaf, the fields on the carrier leaf being offset from one another by the stagger of the cheques so that the reproduced inscriptions form a journal for the sub-set of cheques. An analysis leaf overlies the first sub-set of cheques and is bound together with other elements of the assembly at its left hand edge. This analysis leaf has analysis fields delineated on the under-surface to provide an analysis facility to the left of the journal entry. The under surfaces of successive carrier leaves also define analysis fields opposite corresponding journal entries on the next successive carrier leaf for subsequent sub-sets of cheques.

One factor which makes this known arrangement inconvenient to use is that the analysis appears to the left of the journal whereas for conventional accounting practice analysis is always to the right of the journal.

An objective of the invention is to provide a cheque book assembly in which this disadvantage of the known arrangement is avoided.

SUMMARY OF THE INVENTION

In accordance with the present invention there is provided a cheque book assembly including a set of cheques and having facilities for journal entries recording particulars of cheques issued therefrom and for analysis entries for classifying expenditure, the assembly comprising a plurality of carrier leaves arranged one above another and bound together at their right hand ends, a sub-set of cheques carried on each carrier leaf with the cheques overlaying the carrier leaf in a staggered overlap with respect to one another and bound detachably to the carrier leaf at the left hand ends of the cheques and carrier leaf, first pressure sensitive reproduction means for causing an inscription effected on an elongated field forming part of the surface of a first cheque to be reproduced on a corresponding first field delineated on the carrier leaf to provide a journal entry for the first cheque on the carrier, second and successive pressure sensitive reproduction menas for causing second and successive inscriptions respectively on second and successive cheques respectively to be reproduced on second and successive fields respectively of the carrier leaf, the fields on the carrier leaf being offset from one another by the stagger of the cheques so that the reproduced inscriptions form a journal for the sub-set of cheques, a first analaysis leaf overlying the first sub-set of cheques and bound to the carrier leaves at the right hand edge thereof and having analysis fields delineated on the under surface thereof such that when opened away from the first carrier leaf analysis fields for each cheque are provided to the right of the journal entries, the under-surfaces of successive carrier leaves defining analysis fields opposite corresponding journal entries on the next successive carrier leaf for subsequent sub-sets of cheques.

It is preferred that the successive carrier leaves with their analysis fields should each be constituted by a single sheet of paper but alternatively each carrier leaf could be constituted by two sheets arranged back to back with journal fields on one face of one sheet and analysis fields on the opposite surface of the other sheet.

Preferably the cheque book assembly is provided with a base cover member bound at its right hand end to the carrier leaves. Preferably the left hand end of the base cover member carries a shield which can be folded under the carrier leaf of the uppermost remaining sub-set of cheques to protect lower parts of the assembly against inadvertent duplicated journal entries.

Preferably the assembly also incorporates an upper cover member bound at its right hand end to the carrier leaves.

Preferably the cheques are rendered detachable by having perforations adjacent their left hand edges and preferably the carrier leaves are also perforated adjacent their left hand edges such that remaining left hand edge portions of the cheques of a sub-set can be removed together along with the left hand edge portion of the carrier leaf after use of all cheques in that sub-set.

BRIEF DESCRIPTION OF THE DRAWINGS

An embodiment of the invention will now be described by way of example only with reference to the accompanying drawings in which.

DESCRIPTION OF A PREFERRED EMBODIMENT

Figure 1:
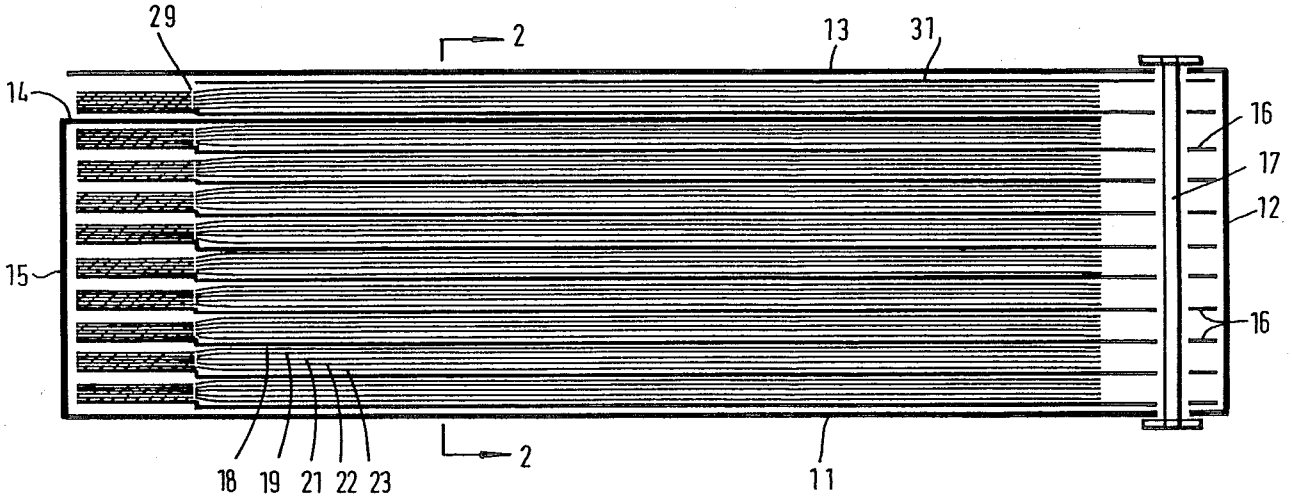
FIG. 1 is a diagrammatic longitudinal cross-section through a cheque book assembly in accordance with the invention showing vertical dimensions on a substantially enlarged scale for the purposes of clarity.
Figure 2:
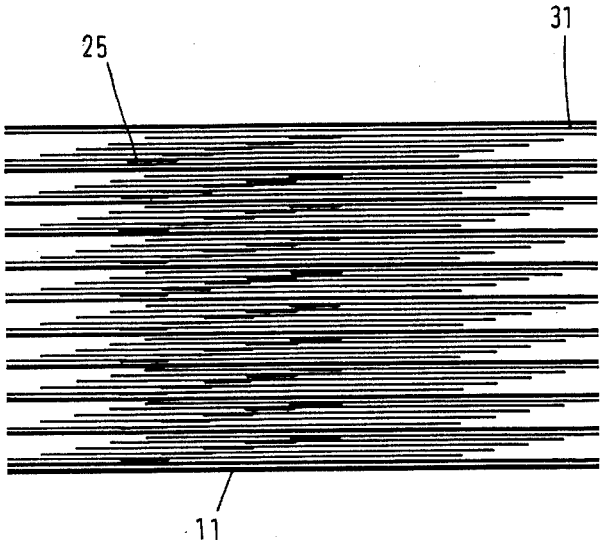
FIG. 2 is a cross-section on line 2—2 on a similar scale.
Figure 3:
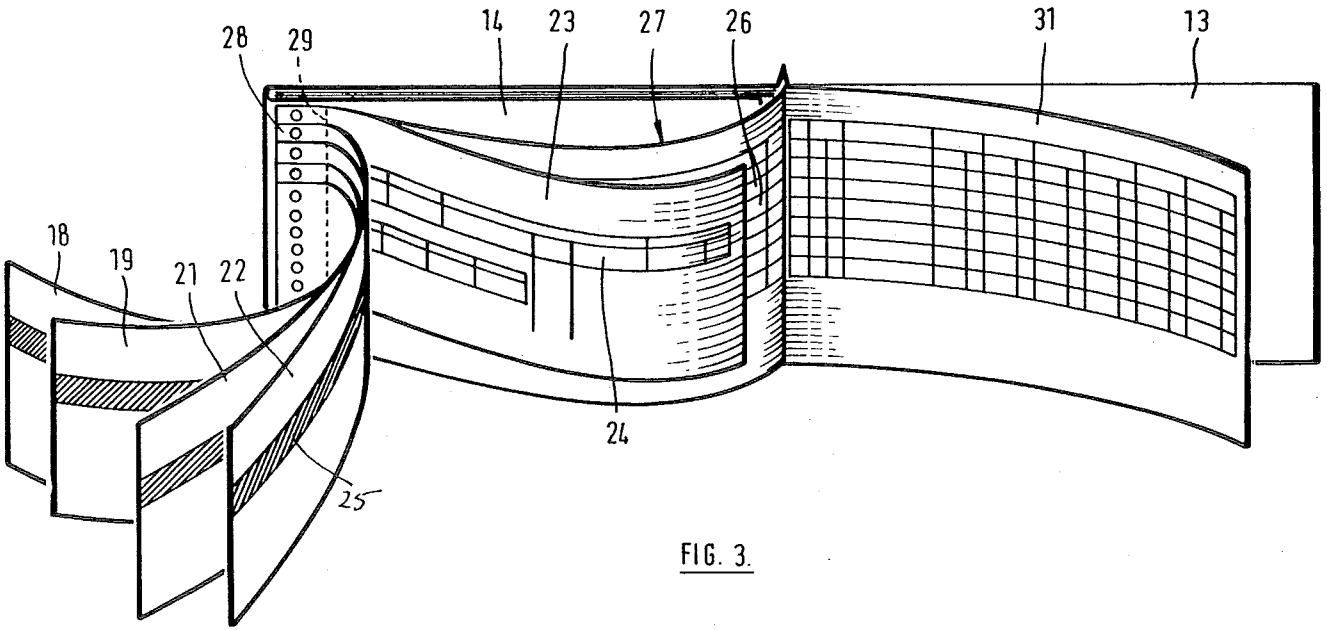
FIG. 3 is a perspective view of the assembly in a partially open position.

The cheque book assembly as shown in FIGS. 1, 2 and 3 incorporates a base cover member 11, a spine 12, an upper cover member 13 and a shield 14 all formed integrally from a single sheet of card by folds at the inter-connections between these parts. In order to space the shield 14 from the base cover member 11, a narrow spine-like rib 15 is also incorporated in this card. A series of ten carrier leaves 16 are bound into the cover assembly in the region of the spine 12 by detachable fasteners 17. The upper and lower cover members, the shield 14 and the carrier leaves 16 are all generally rectangular, of approximately the same size as each other and overlie each other in the manner shown. Their size is somewhat longer and wider than a typical cheque as will be explained subsequently.

Figure 4:
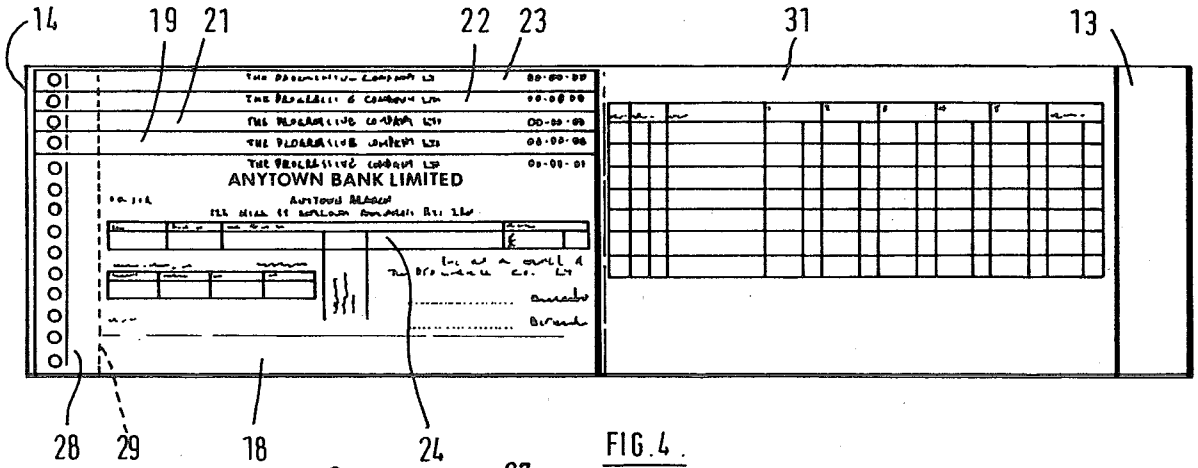
FIG. 4 is a view of the cheque book assembly in a flat open condition, ready for use.
Figure 5:
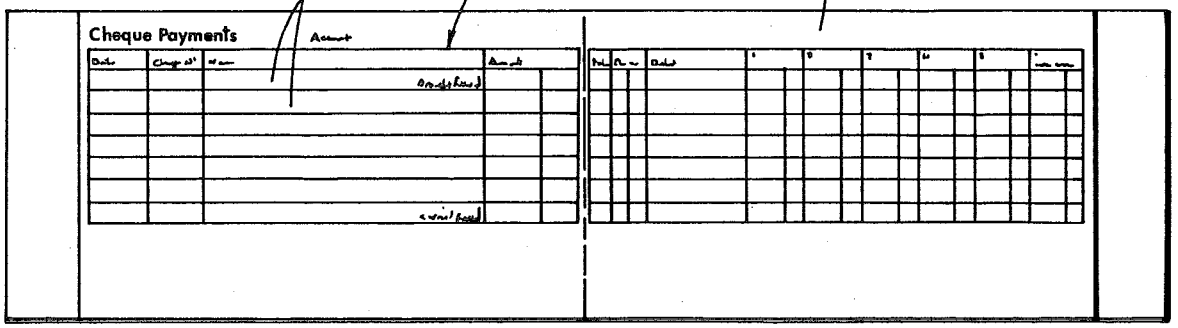
FIG. 5 is a view corresponding to FIG. 4 but with a sub-set of cheques removed.

Each carrier leaf 16 carries a sub-set of five cheques arranged in a staggered overlap (often known as a shingled arrangement) as best illustrated in FIGS. 2, 3 and 4. FIG. 3 shows the whole of an uppermost cheque 18 and upper edges of four further cheques 19, 21, 22 and 23. Each of these cheques incorporates an elongated field such as 24 for cheque 18 and this field has provision for inscription of basic data relating to the cheque, in this case the date, cheque number, payee and amount. The underside of this field incorporates a carbon coating illustrated at 25 in FIGS. 2 and 3. This carbon coating constitutes a means for causing an inscription effected on the elongated field 24 to be reproduced on a corresponding field delineated on the carrier leaf 16 immediately below it. As shown in FIG. 4, these files 26 constitute rows in a table 27 which constitutes a journal. Individual columns of the journal are headed to show that they display the same data as inscribed on the field 24 of a cheque.

The first (uppermost) row of the journal 27 coincides in position with the field 24 of cheque 23. As subsequent cheques 22, 21 19 and 18 are staggered in a downward direction, the corresponding fields in the journal which are in register with the field 24 of each successive cheque coincide with successively lower rows 26.

Each cheque is printed on over-size paper leaving a margin 28 to the left of the cheque by means of which all the cheques can be secured by an adhesive one above the other in their staggered formation to the carrier leaf 16. Each cheque is detachable from its carrier leaf by a line of perforations 29 between the cheque itself and its margin 28. The complete left hand edge of the carrier leaf incorporating the series of margins 28 is also detachable from the main part of the carrier leaf by further perforations.

A first analysis leaf 31 (shown clearly in FIGS. 3 and 4) incorporates an analysis table made up of individual fields in columns and rows. Each row corresponds to and is directly opposite a row of the journal and is intended for recording analysis data in respect of the payment for the journal entry. Typically, there may be one wide column for descriptive material and a further series of columns each associated with a particular class of expenditure. This enables the payment associated with a journal entry to be analysed into an appropriate class of payment. The journal and analysis tables can be entirely conventional accounting tools and are not described in any further detail.

Below the first sub-set of cheques associated with the uppermost carrier leaf are several further sub-sets of cheques all identical to the first sub-set and all carried on identical carrier leaves. For the second and subsequent sub-sets of cheques, the required analysis leaf is constituted by the immediately preceding carrier leaf with an analysis table printed on the reverse side thereof. The arrangement is thus such that when the cheque book assembly is opened at the uppermost cheque sub-set, an analysis table is always available to the right opposite to the cheque sub-set.

In use of the cheque book assembly, it is first of all ensured that the shield 14 is in position immediately below the uppermost sub-set of cheques on its carrier leaf. The lowermost cheque in the sub-set, that is the cheque which is under any other cheques but is higher up the page than any other cheques (e.g. cheque 23 in FIG. 4) is the first cheque in the sequence and is used first. Simply by writing the usual payment data, namely date, payee and amount in the field 23, an almost complete journal entry is effected. To complete the journal entry, the cheque number (normally also printed on cheque) is repeated in the appropriate part of the field 24. This cheque number is reduntant on the cheque itself but is required in the journal. The cheque is then removed by tearing along the perforations at its left hand edge. Any required analysis data can then be recorded directly opposite the now visible journal entry in the journal table.

The next cheque in the series, e.g. cheque 22, then comes into direct contact with the carrier leaf so that an inscription on field 24 of this second cheque results in a journal entry in the second row. This process of writing and removing cheques and making any required analysis entries is continued until all the five cheques from the sub-set have been used. At that stage, the remaining margins such as 28 of the five cheques together with a corresponding margin of the associated carrier leaf are removed by tearing along perforations of the carrier leaf and are discarded. The carrier leaf is then folded over to the right to expose its analysis table. The shield 14 is then placed under the next sub-set of cheques mounted on its carrier leaf and the same sequence as before is followed.

This operation continues until all the cheques in the cheque book have been used. At that stage, the whole of the remaining part of the cheque book, namely the complete cover member and the various carrier leaves may be retained as a unit. Alternatively, the carrier leaves together with the first analysis leaf may be removed together from the remains of the cheque book assembly and placed in a more permanent binder. In this way the binder can be used to collect together the journal and analysis data from a series of cheque books.

By restricting the assembly to five cheques in each sub-set it is possible to produce a cheque book assembly in accordance with the present invention which is small enough to fit in a pocket and thus to be carried round easily. However, the arrangement could be modified to include a substantially larger number of cheques in each sub-set, whereupon it would become more appropriate for use within an office environment. In either case, the facility for analysis entries to the right and automatic journal entries produced by writing the cheque on the left results in a total system which is convenient to use and compatible with normal accounting practice.

I claim:

1. A cheque book assembly including a set of cheques and having facilities for journal entries recording particulars of cheques issued therefrom and for analysis entries for classifying expenditure; the assembly comprising a plurality of carrier leaves each having right and left hand ends and first and subsequent fields delineated thereon and being arranged one above another; binding means binding the carrier leaves together at their right hand ends; a sub-set of cheques having right and left hand ends and carried on each carrier leaf with the cheques overlaying the carrier leaf in a staggered overlap with respect to one another and bound detachably to the carrier leaf at the left hand ends of the cheques and carrier leaf; an elongated inscription field forming part of the surface of each cheque; first pressure sensitive reproduction means for causing an inscription effected on said elongated field of a first cheque to be reproduced on said first field delineated on the carrier leaf to provide a journal entry for the first cheque on the carrier; second and successive pressure sensitive reproduction means for causing second and successive inscriptions respectively on second and successive cheques respectively to be reproduced on second and successive fields respectively of the carrier leaf; the fields on the carrier leaf being offset from one another by the stagger of the cheques so that the reproduced inscriptions form a journal for the sub-set of cheques; a first analysis leaf overlying the first sub-set of cheques and bound to the carrier leaves at the right hand edge thereof and having analysis fields delineated on the under surface thereof such that when opened away from the first carrier leaf analysis fields for each cheque are provided to the right of the journal entries, the under-surfaces of successive carrier leaves defining analysis fields opposite corresponding journal entries on the next successive carrier leaf for subsequent sub-sets of cheques.

2. An assembly according to claim 1 further provided with a base cover member having right and left hand ends and bound at its right hand end to the carrier leaves.

3. An assembly according to claim 2 further comprising a shield carried by the left hand end of the base cover member the shield being foldable under the carrier leaf of the uppermost remaining sub-set of cheques to protect lower parts of the assembly against inadvertent duplicated journal entries.

4. An asesmbly according to claim 1 incorporating an upper cover member bound at its right hand end to the carrier leaves.

5. An assembly according to claim 1 wherein the cheques are rendered detachable by having perforations adjacent their left hand edges.

6. An assembly according to claim 5 wherein the carrier leaves also have perforations adjacent their left hand edges such that remaining left hand edge portions of the cheques of a sub-set can be removed together along with the left hand edge portion of the carrier leaf after use of all cheques in that sub-set.

* * * * *